US012540541B2

(12) United States Patent
Huang

(10) Patent No.: US 12,540,541 B2
(45) Date of Patent: Feb. 3, 2026

(54) SYSTEM FOR GENERATING OPERATING PARAMETERS OF AN EARTH-BORING TOOL AND RELATED METHODS

(71) Applicant: Baker Hughes Oilfield Operations LLC, Houston, TX (US)

(72) Inventor: Xu Huang, Spring, TX (US)

( * ) Notice: Subject to any disclaimer, the term of this patent is extended or adjusted under 35 U.S.C. 154(b) by 0 days.

(21) Appl. No.: 18/621,920

(22) Filed: Mar. 29, 2024

(65) Prior Publication Data

US 2025/0305402 A1 Oct. 2, 2025

(51) Int. Cl.
*E21B 44/00* (2006.01)
*E21B 45/00* (2006.01)

(52) U.S. Cl.
CPC ..... *E21B 44/00* (2013.01); *E21B 45/00* (2013.01); *E21B 2200/20* (2020.05)

(58) Field of Classification Search
CPC ..... E21B 44/00; E21B 45/00; E21B 2200/20
See application file for complete search history.

(56) References Cited

U.S. PATENT DOCUMENTS

2021/0115778 A1 4/2021 Rangarajan et al.
2021/0324723 A1* 10/2021 Madasu ..... E21B 44/00
2023/0116456 A1 4/2023 Saidutta et al.
2023/0313678 A1 10/2023 Saihati et al.

FOREIGN PATENT DOCUMENTS

KR 10-2294384 B1 8/2021
WO 2021/243021 A1 12/2021

OTHER PUBLICATIONS

International Search Report for Application No. PCT/US2025/021692 dated Jul. 1, 2025, 3 pages.
International Written Opinion for Application No. PCT/US2025/021692 dated Jul. 1, 2025, 7 pages.

* cited by examiner

*Primary Examiner* — Dany E Akakpo
(74) *Attorney, Agent, or Firm* — Baker Hughes Company

(57) ABSTRACT

An earth-boring tool system may include a drill string including at least one drilling tool. The earth-boring tool system may also include at least one processor and at least one non-transitory computer-readable storage medium storing instructions to cause the earth-boring tool system to receive first drilling environment data, train an operational drilling model based, at least in part, on the first drilling environment data and a reward function defining one or more rewards or punishments based, at least in part, on one or more drilling parameters including bit wear, rate of penetration (ROP), Stick Slip, cutter durability, or a reference baseline drilling policy, receive second drilling environment data, and determine, via the operational drilling model, one or more first actions based on the second drilling information data, the one or more first actions configured to change one or more operating parameters of the earth-boring tool system.

20 Claims, 8 Drawing Sheets

SYSTEM FOR GENERATING OPERATING PARAMETERS OF AN EARTH-BORING TOOL AND RELATED METHODS

TECHNICAL FIELD

Embodiments of the present disclosure relate generally to systems and methods for developing models for generating operating parameters for earth-boring tools.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using earth-boring tools, such as an earth-boring rotary drill bit. The earth-boring rotary drill bit is rotated and advanced into the subterranean formation. As the earth-boring rotary drill bit rotates, the cutting elements, cutters, or abrasive structures thereof cut, crush, shear, and/or abrade away the formation material to form the wellbore.

The earth-boring rotary drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom-hole assembly" (BHA).

Additionally, various machine learning techniques may be used to classify, interpret, or generate data by training a machine-learning based model. A machine learning based model may be given an input and a desired output and may then extract patterns from the data to "learn" how to achieve the desired output given the input data. For example, one type of machine learning involves the use of neural networks. A neural network may include layers of nodes, an input layer, one or more hidden layers, and an output layer. Each node of a neural network may be configured to communicate with one or more other nodes of the neural network based on the input, one or more parameters of a given node, and weights assigned to those parameters to generate an output. During a training process, the neural network may automatically adjust the parameter values or weights associated with the parameter values based on provided desired outputs to better achieve a desired output given an input.

Reinforcement learning (RL) is a type of machine learning paradigm where an agent learns to make decisions by interacting with an environment. The agent takes actions within the environment, and in response, the environment provides feedback in the form of rewards or punishments. The goal of the agent is to learn a policy, a strategy or a set of rules, that maximizes the cumulative reward over time.

BRIEF SUMMARY

Some embodiments of the present disclosure include an earth-boring tool system including a drill string including at least one drilling tool. The earth-boring tool system may also include at least one processor and at least one non-transitory computer-readable storage medium storing instructions. The instructions, when executed by the at least one processor, may cause the earth-boring tool system to receive first drilling environment data, train an operational drilling model based, at least in part, on the first drilling environment data and a reward function defining one or more rewards or punishments based, at least in part, on one or more drilling parameters including bit wear, rate of penetration (ROP), Stick Slip, cutter durability, or a reference baseline drilling policy, receive second drilling environment data, and determine, via the operational drilling model, one or more first actions based on the second drilling information data, the one or more first actions configured to change one or more operating parameters of the earth-boring tool system.

Further embodiments of the present disclosure include a method of training a machine-learning model via reinforcement learning. The method may include receiving first drilling environment data determining, via an agent, one or more first actions configured to change one or more operational parameters of an earth-boring tool system based, at least in part, on the first drilling environment data and a drilling policy corresponding to the agent simulating, via a predictive machine learning model, one or more future states of the earth-boring tool system based on the first drilling environment data and the one or more first actions to generate one or more predicted drilling parameters providing, via a pre-defined reward function, one or more rewards and/or one or more punishments to the agent based, at least in part, on the reward function and the one or more predicted drilling parameters, and updating the drilling policy based on the one or more rewards or the one or more punishments.

Further embodiments of the present disclosure may include a non-transitory computer-readable medium storing instructions thereon that, when executed by the at least one processor, cause the at least one processor to receive first drilling environment data, determine, via an agent, one or more first actions configured to change one or more operational parameters of an earth-boring tool system based, at least in part, on the first drilling environment data and a drilling policy corresponding to the agent, simulate, via a physics-based predictive machine learning model, one or more future states of the earth-boring tool system based on the first drilling environment data and the one or more first actions to generate one or more predicted drilling parameters, provide, via a pre-defined reward function, one or more rewards and/or one or more punishments to the agent based, at least in part, on the reward function and the one or more predicted drilling parameters, update the drilling policy based on the one or more rewards or the one or more punishments receive real-time drilling data via one or more sensors of the earth-boring tool system, determine, via the agent, one or more drilling parameters of the earth-boring tool system based on the real-time drilling data and the policy corresponding to the agent; and initialize or change one or more operating parameters of the earth-boring tool system based, at least in part, on the drilling parameters determined by the agent.

BRIEF DESCRIPTION OF THE SEVERAL VIEWS OF THE DRAWINGS

While this disclosure concludes with claims particularly pointing out and distinctly claiming specific examples, various features and advantages of examples within the scope of this disclosure may be more readily ascertained from the following description when read in conjunction with the accompanying drawings, in which:

DETAILED DESCRIPTION

Figure 1:
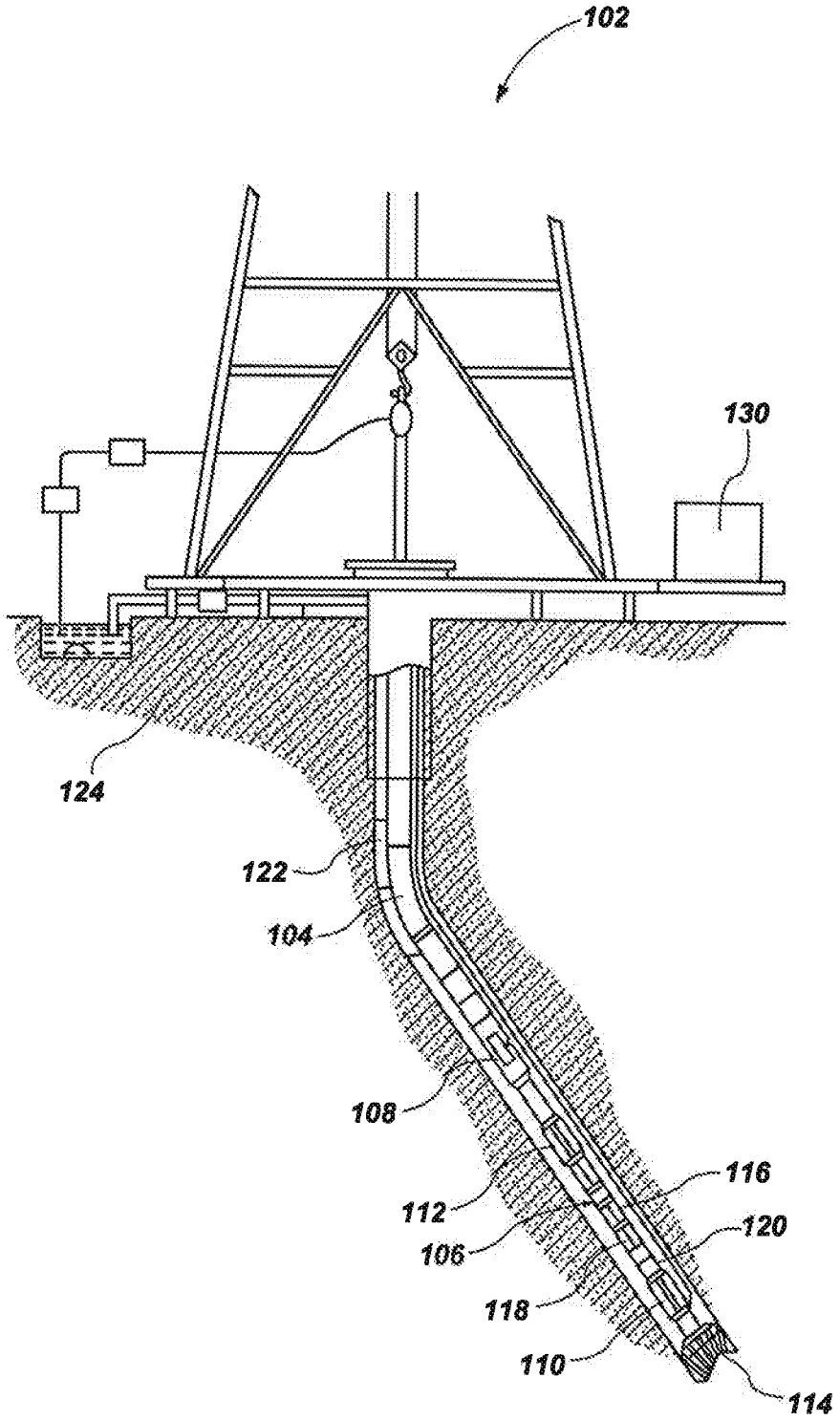
FIG. 1 illustrates an example earth-boring tool system, according to one or more embodiments of the present disclosure.

Downhole drilling operations may involve the use of an earth-boring tool at the end of a long string of pipe commonly referred to as a drill string. An earth-boring tool may be used for drilling through subterranean formations, such as rock, dirt, sand, tar, etc. The act of downhole drilling is a complicated temporal process requiring a plurality of factors to be taken into account. For example, as an earth-boring tool cuts into the earth, the earth-boring may encounter several different types of rock formations and/or layers that have different properties (e.g., differing densities, formation structures, etc.), which may each require different operating parameters for the drill bit in order to drill efficiently and ensure that the drill bit is not damaged. For example, different rock layers or formations may require an operator to adjust operating parameters including weight on bit (WOB), torque on bit (TOB), string rotational speed (RPM), etc., in order to drill through different rock layers or formations to achieve an efficient rate of penetration (ROP) in a manner in which damage to the drill bit is prevented by avoiding, for example, excessive tool vibration and/or excessive WOB. However, because of the large amount of different variables that an operator must keep track of in order to make an informed decision to change an operating parameter of the earth-boring tool, it may be difficult for an operator to respond to the volume of changes experienced by an earth-boring tool during a drilling operation, which may lead to inefficiencies and possible damage to the earth-boring tool. Furthermore, a drilling operator is typically only able to monitor and change operating parameters relating to RPM and WOB, and so may have a narrowed ability to address changing drilling conditions as drilling progresses into the earth. For example, an operator may increase RPM and WOB to increase ROP, but doing so may cause excessive vibrations of the earth-boring tool such that the earth-boring tool is damaged or may cause the durability or wear of the earth-boring tool to degrade at an unanticipated rate, which may lead to catastrophic damage to the earth-boring tool and jeopardize the entire drilling operation. Such events may cause a large amount of unnecessary costs in both tool repair/replacement and lost drilling time.

In some cases, a reinforcement machine learning model may be used to attempt to predict various operating parameters of an earth-boring tool during a drilling operation. However, many reinforcement learning models utilize a reward function that focuses only on rate of penetration as a measure of success or failure, but typically fail to account for other factors such as vibration of the earth-boring tool, which may lead to unforeseen difficulties such as failure of the earth-boring tool, which may lead to loss of expensive down-hole equipment as well as the time it takes to extract the damaged equipment and repair it to allow operations to proceed.

Accordingly, to allow efficient ROP of an earth-boring tool while preventing excessive vibration, tool wear, excessive WOB, or other factors that may result in damage to the earth-boring tool, a machine learning based prediction model may be provided to predict one or more drilling parameters (e.g., one or more vectors) for various depths of a drilling operation to be used during the drilling operation. Furthermore, a reward function may be used to train the machine learning based prediction model using reinforcement learning where the reward function takes into account variables including at least one or more of a predicted wear of the earth-boring tool, cutter durability, vibration of the earth-boring tool, RPM of the earth-boring tool, predicted tool wear, ROP and WOB of the earth-boring tool, etc., compared to a baseline strategy. By using this improved reward function, the machine learning based prediction model may allow the ROP of the earth-boring tool to be increased while decreasing a likelihood of damage to the earth-boring tool. Accordingly because the earth-boring tool system of the present disclosure is able to train a machine learning based prediction model using reinforcement learning and a reward function that takes into account factors such as predicted vibration of the earth-boring tool as well as a predicted wear of the tool, the machine learning based prediction model may be used to allow an earth-boring tool to drill with increased efficiency and prevent the loss or damage of expensive down-hole equipment more effectively than traditional systems or methods.

FIG. 1 illustrates an earth-boring tool system 102 according to one or more embodiments of the present disclosure. An earth-boring tool system 102 may include a drill string 104. The earth-boring tool system 102 may also include electronics, such as sensors 116, sensor modules 118, and/or tool control components 120. The drill string 104 may include multiple sections of drill pipe coupled together to form a long string of drill pipe. A forward end of the drill string 104 may include a bottom hole assembly 106 (BHA). The BHA 106 may include components, such as a motor 108 (e.g., mud motor), one or more reamers 110 and/or stabilizers 112, and an earth-boring tool 114 such as a drill bit. The drill string 104 may be inserted into a borehole 122. The borehole 122 may be formed by the earth-boring tool 114 as the drill string proceeds through a formation 124. The tool control components 120 may be configured to control an operational aspect of the earth-boring tool 114. For example, the tool control components 120 may include a steering component configured to change an angle of the earth-boring tool 114 with respect to the drill string 104 changing a direction of advancement of the drill string 104. The tool control components 120 may be configured to receive instructions from an operator at the surface and perform actions based on the instructions. The earth-boring tool system 102 may include an operator terminal 130 to allow an operator to interact with various functions of the earth-boring tool system 102. In some embodiments, control instructions may be derived downhole within the tool control components 120, such as in a closed loop system, etc.

The sensors 116 may be configured to collect information regarding the earth-boring tool 114, such as tool temperature, cutter temperature, cutter wear, vibration, weight on bit (WOB), torque on bit (TOB), string rotational speed (RPM), and the wear (e.g., degradation, dulling, or damage) of at least part of the earth-boring tool 114. The information collected by the sensors 116 may be processed, stored, and/or transmitted by the sensor modules 118. For example, the sensor modules 118 may receive the information from the sensors 116 in the form of raw data, such as a voltage (e.g., 0-10 VDC, 0-5 VDC, etc.), an amperage (e.g., 0-20 mA, 4-20 mA, etc.), or a resistance (e.g., resistance temperature detector (RTD), thermistor, etc.). The sensor modules 118 may process raw sensor data and transmit the data to the surface on a communication network, using a communication network protocol to transmit the raw sensor data. The communication network may include, for example, a communication line, mud pulse telemetry, electromagnetic telemetry, wired pipe, etc. In some embodiments, the sensor modules 118 may be configured to run calculations on raw sensed data such as, for example, calculating various signs of wear and/or damage to the earth-boring tool 114 relative to a known undamaged, unworn, or initial state of the earth-boring tool 114.

Though shown in FIG. 1 as being located on a section of the drill string the sensors 116 may be located anywhere within the earth-boring tool system 102 (e.g., anywhere on the wellbore or located directly on the drill string 104 or the earth-boring tool 114 or at or near the mouth of the wellbore) such that the sensors are able to detect wear of at least part of at least one drilling tool (e.g., earth-boring tool 114).

In some embodiments, the downhole information may be transmitted to the operator at the surface or to a computing device at the surface. For example, the downhole information may be provided to the operator through a display, a printout, etc. In some embodiments, the downhole information may be transmitted to a computing device that may process the information and provide the information to the operator in different formats useful to the operator. For example, measurements that are out of range may be provided in the form of alerts, warning lights, alarms, etc., some information may be provided live in the form of a display, spreadsheet, etc., whereas other information that may not be useful until further calculations are performed may be processed and the result of the calculation may be provided in the display, print out, spreadsheet, etc. In some embodiments, the sensors 116 may be configured to capture image data representative of various parts of the earth-boring tool 114 and provide the image data to the display. An operator may then manually measure, calculate, or otherwise obtain wear parameters of the earth-boring tool 114 based on the provided image data or other data collected by the sensors 116.

In some embodiments, the information sensed by the sensors 116 may be used to generate one or more operational drilling models configured to change one or more operating parameters of the earth-boring tool system 102 over distance drilled in the formation 124. For example, the earth-boring tool system 102 may automatically adjust one or more drilling parameters including, but not limited to, one or more of rate of penetration (ROP), drilling fluid flow rate, weight on bit (WOB), rotations per minute (RPM), well geometry, drilling fluid composition, etc., responsive to the generated one or more operational drilling models. In additional embodiments, the earth-boring tool system 102 may provide to the display one or more recommendations for changes to one or more drilling parameters responsive to the generated operational drilling models. An operator may then approve one or more of the one or more recommendations or may manually change one or more drilling parameters based, at least part, on the recommendations.

Figure 8:
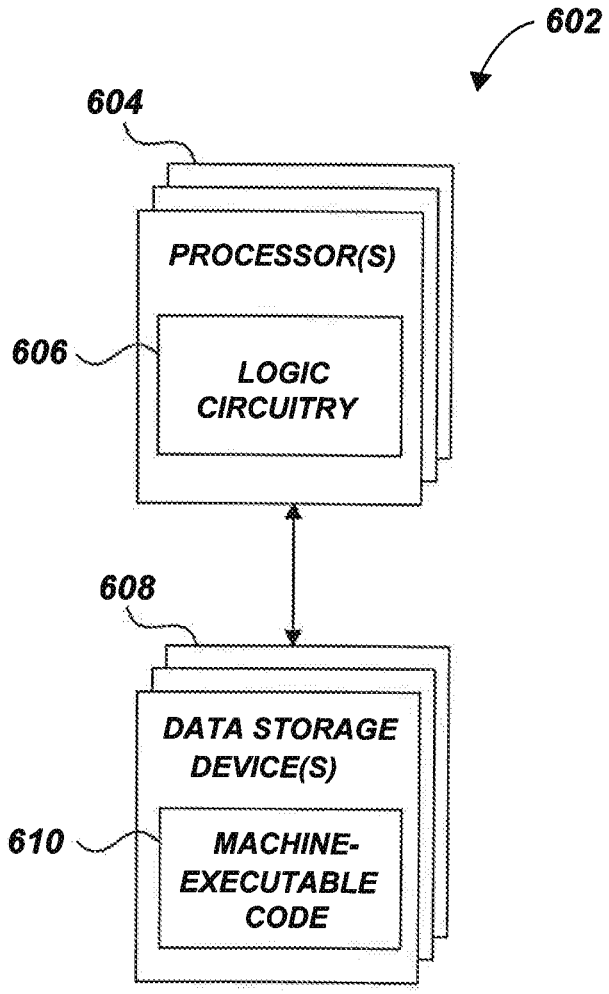
FIG. 8 is a block diagram of circuitry that, in some examples, may be used to implement various functions, operations, acts, processes, and/or methods disclosed herein.

The earth-boring tool system 102 may also include a processor and memory (discussed in more detail with regard to FIG. 8). Additionally, the earth-boring tool system 102 may also include an I/O interface and a communication interface. In one or more embodiments, the processor includes hardware for executing instructions, such as those making up a computer program. The memory may be used for storing data, metadata, and programs for execution by the processor(s). The I/O interface allows a user to provide input to receive output from, and otherwise transfer data to and receive data from, the earth-boring tool system 102 (e.g., to and from sensors 116 via sensor modules 118). The communication interface can include hardware, software, or both. In any event, the communication interface can provide one or more interfaces for communication (such as, for example, packet-based communication) between the earth-boring tool system 102 and one or more other computing devices or networks.

Figure 2:
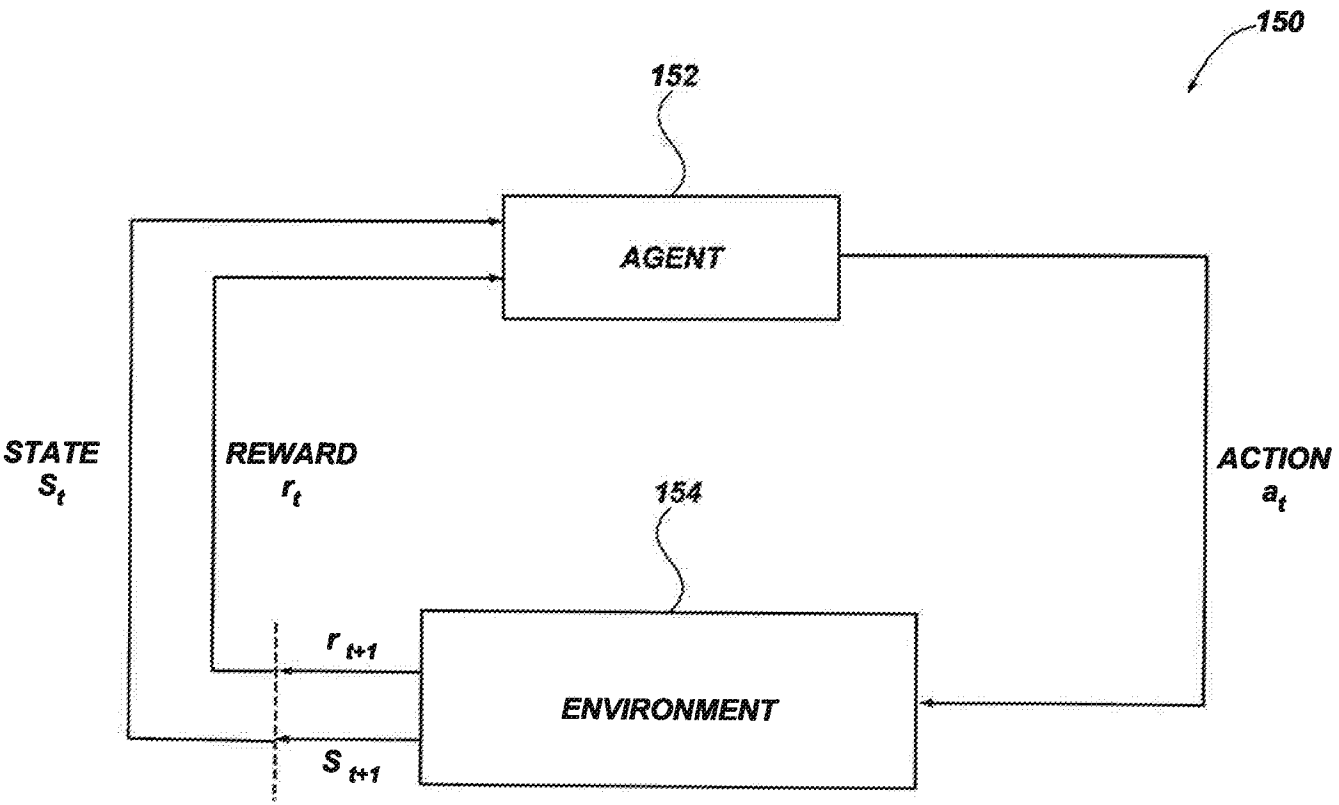
FIG. 2 shows a diagram of an example for a reinforcement learning model, according to one or more embodiments of the present disclosure.

FIG. 2 shows a diagram of an example reinforcement learning model 150. The reinforcement learning model 150 includes an agent 152 and an environment 154. The agent 152 may be a decision-making entity that takes actions (e.g., action at) in the environment 154 (e.g., based on a current state of the environment 154) in order to achieve certain goals defined by a policy of the agent 152. The environment 154 may include an external system with which the agent interacts and provides feedback (e.g., reward rt) to the agent according to a pre-defined reward function. The agent may then update the policy of the agent responsive to the feedback received via the reward function. Furthermore, the environment 154 will also provide the agent 152 with an updated state St responsive to the action at performed by the agent 152 in the environment 154. The agent 152 may then perform one or more additional actions at in the environment responsive to the latest state St of the environment 154 according to updated policy of the agent 152. Though discussed herein using a policy-based reinforcement learning model, any reinforcement learning technique using a reward function may be used including any model-free methods, model-based methods, actor-critic methods, temporal difference methods, exploration strategies, transfer learning, multi-agent reinforcement learning, off-policy and on-policy methods and inverse reinforcement learning.

Figure 3:
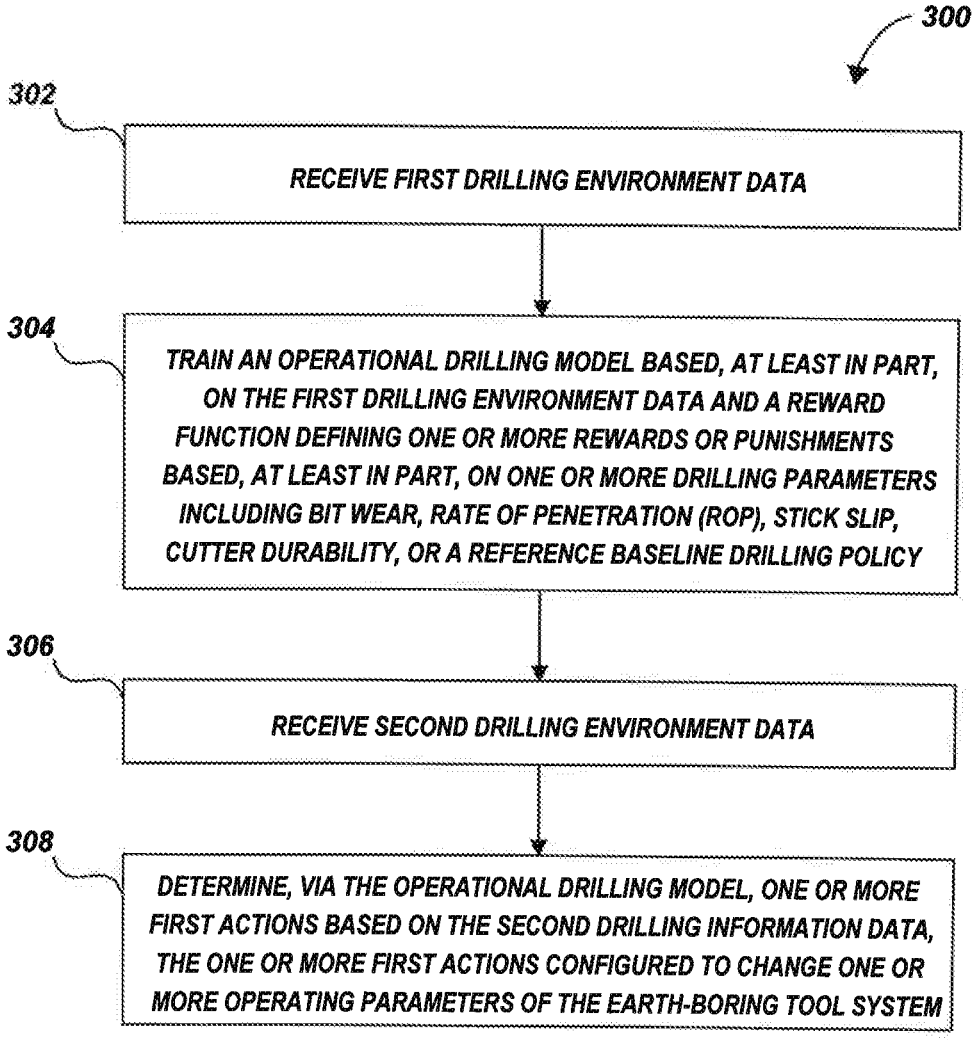
FIG. 3 is a flowchart illustrating an operation of the earth-boring tool system performed by a processor executing instructions stored on a computer-readable storage medium, according to one or more embodiments of the present disclosure.

FIG. 3 is a flowchart 300 illustrating an operation of the earth-boring tool system 102 performed by a processor executing instructions stored on a computer-readable storage medium. For instance, FIG. 2 shows one or more embodiments of a simplified sequence-flow that the earth-boring tool system 102 utilizes to train machine learning models via reinforcement learning using a reward function to generate a predictive model for generating parameters of an earth-boring tool 114 during a drilling operation of the earth-boring tool system 102. As used herein, the phrase "predictive model" may refer to a machine learning model trained, or being trained, for predicting/generating one or more operating parameters of an earth-boring tool 114 to be used during a drilling operation of the earth-boring tool system 102. At operation 302, the earth-boring tool system 102 receives first drilling environment data. For example, the first drilling environment data may be received from a physics-based model configured to simulate operation of the earth-boring tool system 102 in a drilling environment where the physics-based model may generate one or more predicted operating parameters of the earth-boring tool system 102 based on one or more parameters of the earth-boring tool system 102 or other earth-boring tool data input into the physics-based model. For example, in some embodiments the physics-based model may be trained and/or initialized using historic field drilling data. As a specific, non-limiting example, historic field drilling data corresponding to previously drilled wells having properties anticipated to be similar to a prospective well may be used to predict one or more properties of the prospective well. However, any data may be used to train and/or initialize the physics-based model.

The physics-based model may simulate one or more drilling operations of the earth-boring tool system 102 to generate one or more drilling parameters based on one or more input parameters. For example, the physics-based model may receive drilling data including one or more of rock strength, rate of penetration (ROP), weight on bit (WOB), rotations per minute (RPM), well geometry formation geometry, formation density, tool geometry, formation composition, tool rotation, or formation logging data (e.g., gamma ray data, density and photoelectric index data, neutron porosity, resistivity data, image data (e.g., one or more images of a borehole), sonic data, formation pressure, formation fluid data, nuclear magnetic resonance (NMR), or seismic while drilling (SWD) data). In some embodiments, the drilling data may be generated and received via one or more sensors. For example, the drilling data may be received by one or more sensors disposed along a length of a borehole, disposed on the earth-boring tool 114, or otherwise included on various parts included in the earth-boring tool system 102. The one or more sensors may also be configured to detect and communicate the drilling data in real-time and provide the data to the physics-based model and/or one or more other machine-learning models.

Physics-based model may be configured to simulate one or more operations of the earth-boring tool system 102 to generate one or more physics-based predicted operating parameters of the earth-boring tool 114 based, at least in part, on the drilling data input into the physics-based model. For example, the physics-based model may predict one or more of wear of the earth-boring tool 114 (e.g., wear of the earth-boring tool 114 predicted based on the input parameters over a pre-determined drilling depth), cutter wear, predicted cutter durability, vibration data corresponding to the earth-boring tool 114, ROP, stick slip (e.g., whirl/high-frequency torsional oscillations (HFTO)), predicted future wear of the earth-boring tool 114 given the input parameters (e.g., predicted wear for drilling beyond a pre-determined drilling depth for which drilling parameters have not yet been received), etc. Though discussed in terms of specific predicted parameters, any parameters relating to the operation of an earth-boring tool system 102 may be generated. The predicted parameters such as wear, vibration, ROP, durability may also be generated using offset-well data maps or look-up table. For example, an offset-well may be a previously drilled well having similar geological formations and/or conditions as a target well. Moreover, offset-well data may also include drilling data obtained using similar drilling tools as tools planned to be used on a target well. Offset-well data maps may be generated from a previously drilled well to map measured down-hole characteristics to for reference when drilling a target well with similar geological characteristics to the off-set well. As a specific non-limiting example, an offset-well data map may plot WOB averages over RPM averages where each plot point shown in the offset-well data map may exhibit a color representative of vibration magnitude at a given average WOB over average RPM. Furthermore, a look-up table may be used to structure offset-well data. For example, characteristics of the offset-well data may be mapped onto each other based on the off-set well data. As a specific non-limiting example, an input vibration metric may be mapped to one or more average WOB and average RPM values.

Furthermore, though described in terms of using a physics-based model to generate data relating to the earth-boring tool system 102, any machine learning model may be used. For example, in some embodiments, the first drilling environment data may be defined by a data-based regression model or a hybrid data-physics data-driven model (e.g., a conventional neural network) trained on historical field data (e.g., drilling data generated responsive to historical drilling operations) and/or lab data (e.g., lab rock drilling and cutting tests, data predicted via one or more algorithmic or machine-learning techniques) and configured to predict a next state given one or more input parameters relating to an earth-boring tool system.

In operation 304, the earth-boring tool system 102 trains an operational drilling model based, at least in part, on the first drilling environment data and a reward function defining one or more rewards or punishments based, at least in part, on one or more drilling and/or response parameters including bit wear, rate of penetration (ROP), Stick Slip, cuter durability, vibrations, or a reference baseline drilling policy. For example, the operational drilling model may include an agent and an environment. The agent may include a policy that defines what action the agent is to take given a state of the environment. The environment may generate one or more parameters of a drilling operation based, at least in part, on one or more input drilling parameter changes defined by the action of the agent. The environment may be in the form of the one or more physics-based models configured to simulate the operation of the earth-boring tool system 102 to generate one or more drilling parameters for the earth-boring tool 114 or other components of the earth-boring tool system 102.

The operational drilling model may be trained using reinforcement learning based on interactions between the agent and the environment of the operational drilling model. For example, the interaction between the agent and the environment may be modeled as a sequence of discrete steps (e.g., time steps or steps measured in other parameters, such as distance an earth-boring tool has drilled into the earth). At each step, the agent may observe a current state defined by the environment and may then select an action responsive to the current state based on the policy defined by the agent. The action may include changing one or more operating parameters of the earth-boring tool system 102. The environment may then simulate or reflect the action for a next step (e.g., the next foot of drilling into the earth by the earth-boring tool 114) of a simulated (e.g., via the one or more physics-based models) or real-time drilling operation to generate a new state. The resulting new state is then evaluated by a reward function that defines one or more rewards and/or punishments for the action of agent based on the newly predicted or detected state defined by the environment.

Stated another way, the first drilling environment data may define a current state of the earth-boring tool system 102. For example, when the environment is in the form of a physics-based model, the model may simulate the operation of the earth-boring tool system 102 given provided input parameters (e.g., field data or data simulated via a physics-based model) over a pre-defined drilling depth (e.g., distance that the earth-boring tool 114 has penetrated or has been simulated to penetrate, into the earth) to generate a current state of the earth-boring tool system 102. Given the current state of the environment, the agent may determine one or more operating parameters of the earth-boring tool system 102 based on the current state and a drilling policy of the agent. The determined one or more operating parameters may then be input into the physics-based model, which may then simulate the operation of the earth-boring tool system 102 of drilling a predetermined distance into the earth (e.g., one foot of drilling distance simulated or performed by the earth-boring tool 114). When the action of drilling the pre-determined distance has been completed, the environment 154 may then define a new state of the earth-boring tool system 102. The reward function may then take as input one or more parameters (e.g., one or more predicted drilling parameters) defined by the new state of the environment and determine one or more rewards and/or punishments for the agent based on the resulting new state of the environment (e.g., parameters defined by the new state of the environment). As a specific, non-limiting example, one example reward function may be defined as follows:

Reward=function((bonus_ROP,punish_wear,punish_TD,punish_vibration,punish_durablity)−BaselineStrategy_performance)

As shown above, one example reward function may provide a reward for an increase in ROP compared to a baseline strategy performance, may provide a punishment for wear exceeding a pre-determined threshold (e.g., exceeding wear at like distance of the baseline strategy performance), may provide a punishment for reduced tool durability compared to a baseline strategy performance, may provide a punishment for vibrations above a pre-determined threshold (e.g., exceeding those of the baseline strategy performance), and may provide a punishment for reduced tool durability compared to a baseline strategy performance. However, any reward function comparing any number of drilling parameters of the earth-boring tool system 102 to a reference baseline performance metric or one or more pre-determined thresholds or any other comparative value may be used. In some embodiments, the baseline strategy performance metric may represent known performance represented in historical drilling data (e.g., previous runs performed using one or more machine-learning models) or drilling data received via one or more simulated drilling operations (e.g., simulated via a machine-learning model).

After a pre-determined number of steps, (e.g., after drilling a pre-determined segment of time or a predetermined distance, such as 100 ft), the various rewards and/or punishments given to the agent at each step may then be combined or otherwise aggregated for assessment. For example, the various rewards and/or punishments may be averaged (e.g., a linear average) to generate a performance result. The policy of the agent is then updated responsive to the performance result. For example, the policy may define a mapping of states to actions where the mapping and/or one or more weights assigned to each mapping may be updated responsive to the reward and/or punishments or the finalized performance result. As a specific, non-limiting example, if the performance result reflects that more rewards than punishments were given by the reward function, the various mappings or weights of each mapping of the policy may be changed such that the policy will cause the agent to be more likely to take future actions similar to those actions taken within the preceding pre-determined number of steps.

In some embodiments, the reward function may be in the form of a predictive model (e.g., a pre-trained neural network) configured to predict one or more rewards and/or punishments based on one or more input parameters including, for example, predicted wear of the earth-boring tool 114 over a pre-determined drilling depth, target depth, cutter durability, vibration data corresponding to the earth-boring tool 114, ROP, stick slip (e.g., whirl/high-frequency torsional oscillations (HFTO)), predicted future wear of the earth-boring tool 114, etc. The reward function in the form of a predictive model may also be configured to provide a performance result responsive to the one or more input parameters (e.g., collective actions of the agent). Though described generally as a deterministic policy (e.g., a policy that maps each state to a specific action), the policy of the agent may be any conventionally known policy type. For example, the policy may be in the form of a stochastic policy, exploration-exploitation policy, optimal policy, etc.

In some embodiments, the rewards and/or punishments generated via the reward function may be evaluated, and the policy of the agent updated, at the end of every step. For example, in some embodiments the policy defined by the agent of the earth-boring tool system 102 may be updated responsive to a simulated or actual drilling performed by earth-boring tool system 102 of a predetermined distance (e.g., one foot) into the earth and an assessment via the reward function of the resulting parameters of the earth-boring tool system 102 at the end of the pre-determined distance. Moreover, the policy of the agent may be updated after any number of steps so long as rewards and/or punishments may be used to update a policy of the agent.

In operation 306, the earth-boring tool system 102 receives second drilling environment data. For example, the second drilling environment data may be in the form of real-time drilling parameter data received via one or more sensors 116 of the earth-boring tool system 102 where the second drilling environment data is indicative of a current state of the earth-boring tool system 102 and/or the rock formation currently being drilled. Moreover, the earth-boring tool system 102 may receive new drilling environment data at predetermined intervals during a drilling operation. For example, the sensors may update parameters defining a current state of the earth-boring tool system 102 every one foot of distance drilled into a formation (e.g., formation 124). However, any interval may be chosen using any parameters (e.g., using a time parameter, such as every five seconds). In some embodiments, the second drilling environment data may include predictive data via one or more predictive models (e.g., a physics-based model) instead of, or in addition to, the real-time drilling data. For example, the predictive data may include data indicative of a predicted wear or durability of a cutter or tool of the earth-boring tool system 102. In some embodiments, the predictive data may be based on the real-time data received from the one or more sensors 116 of the earth-boring tool system 102.

In operation 308, earth-boring tool system 102 determines, via the operational drilling model, one or more actions based on the second drilling information data, the one or more actions configured to change one or more operating parameters of the earth-boring tool system 102. For example, the agent of the operational drilling model may, at each of a plurality of pre-defined steps (e.g., predetermined amount of time or a predetermined distance the earth-boring tool system 102 has drilled into the earth), determine one or more parameters of the earth-boring tool system 102. The earth-boring tool system 102 may then be updated to operate according to the one or more parameters determined by the agent of the operational drilling model. This process may then be repeated until the end of the drilling operation of the earth-boring tool system 102.

In some embodiments, the action decided by the agent may, before being implemented, be provided to an operator via a display of the earth-boring tool system 102 for approval or disapproval by the operator. If the operator disapproves then no action will take place. If approved, the action will be implemented in the earth-boring tool system 102 (e.g., one or more operating parameters of the earth-boring tool system may be changed).

Figure 4:
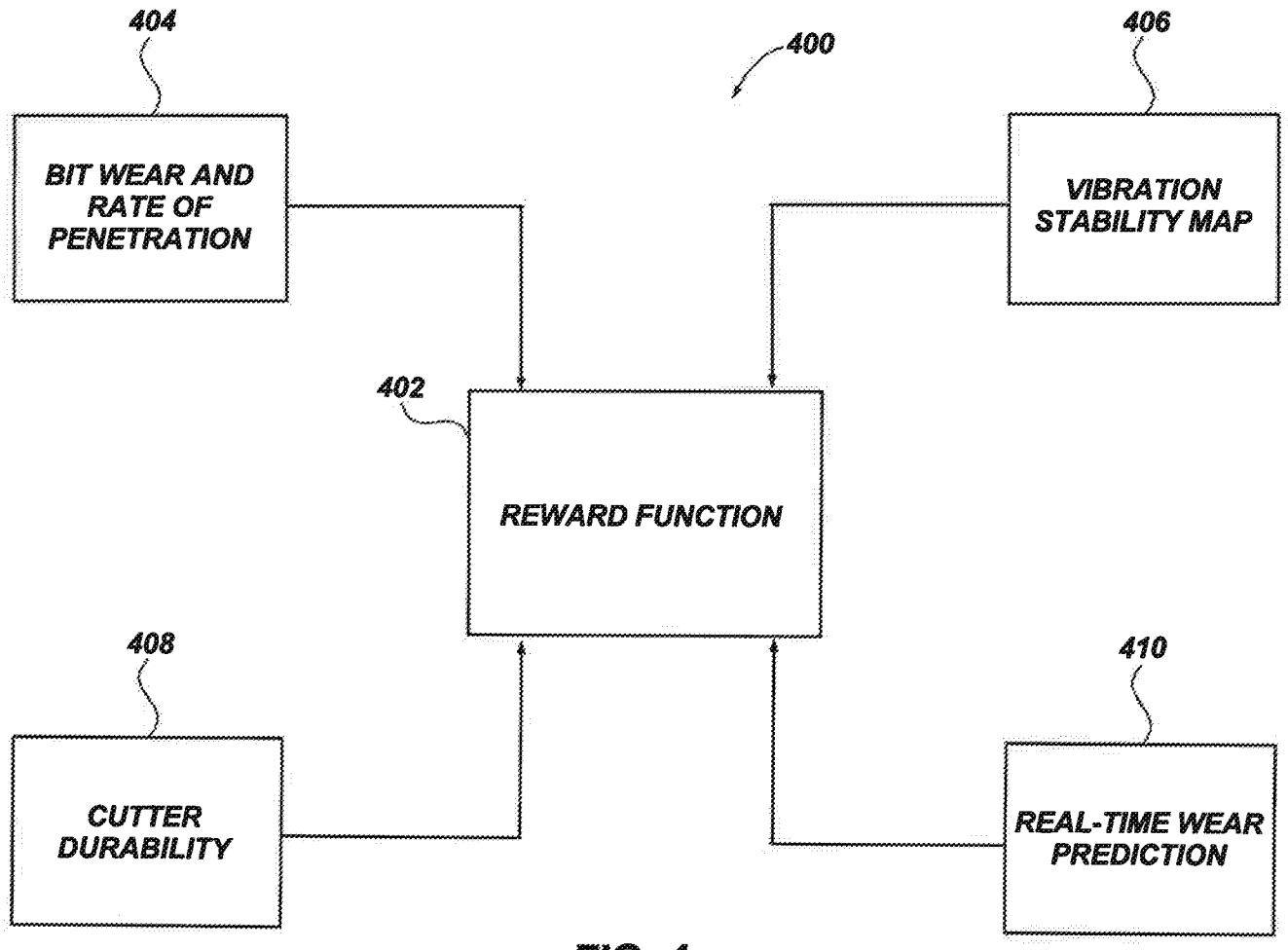
FIG. 4 illustrates a flow diagram showing various parameters representative of results of an action taken by an agent and utilized by a reward function to determine one or more rewards and/or punishments based on the action results, according to one or more embodiments of the present disclosure.

FIG. 4 illustrates a flow diagram 400 showing various parameters representative of results of an action taken by an agent and utilized by a reward function 402 to determine one or more rewards and/or punishments based on the action results, according to one or more embodiments of the present disclosure. For instance, a physics-based model may simulate an action of the agent to generate one or more predicted drilling parameters based on the action. As shown in FIG. 4, the parameters generated by the physics-based model may include bit wear and rate of penetration 404, cutter durability 408, vibration/stability data (e.g., vibration stability map 406), and a real-time wear prediction 410 parameter. The reward function may then generate one or more rewards and/or functions based on the parameters predicted by the physics-based model, which may then be used by the agent to update a policy of the agent. Additionally, the actor may then use the parameters generated by the physics-based model to generate a next action to be implemented in the drilling operation and also considered by the reward function. By performing these steps any number of times, a policy may be developed and used during real-time drilling operations to allow an earth-boring system (e.g., earth-boring tool system 102) to respond to variations in formation properties of a formation being drilled into by the earth-boring tool system 102.

In some embodiments, the physics-based model may be trained (or re-trained) using drilling data similar to that of an anticipated well site. For example, data obtained from a well site within a pre-determined distance may be used to train a physics-based model to allow the physics-based model to simulate conditions of the anticipated well to have like properties of wells within a close proximity to the anticipated well. Furthermore, the reward function may also be generated or updated to reflect expected or known conditions of wells having similar well properties to the anticipated well. For example, the reward function may use a variable baseline strategy performance metric to measure the predicted parameters against considering what is expected or what was encountered in similar wells (e.g., wells in close proximity to the anticipated wells).

Though discussed in terms of a single physics-based model, any number of physics-based models may be used. Furthermore, any type of machine-learning model may be used (e.g., conventional neural networks) so long as predicted parameters of a drilling operation may be predicted using the machine-learning model.

Figure 5:
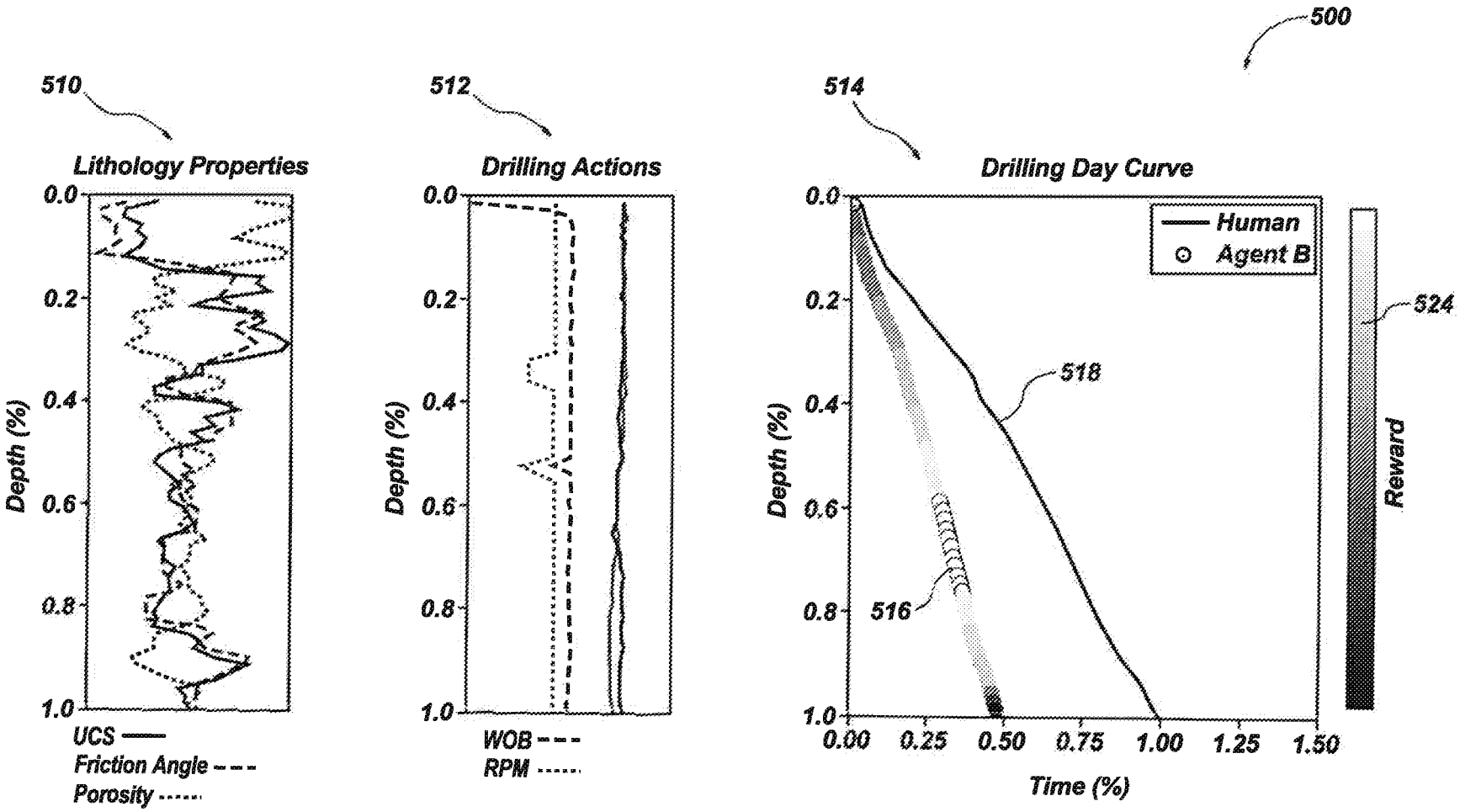
FIG. 5 shows three graphs depicting various performance metrics of drilling operations, according to one or more embodiments of the present disclosure.

FIG. 5 shows three graphs 500 depicting various performance metrics of drilling operations, according to one or more embodiments of the present disclosure. Graph 510 illustrates normalized variations of rock properties as a function of depth. For example, the dotted line illustrates normalized variations in porosity in a rock formation, the dashed line illustrates normalized variations in a friction angle in the rock formation and the solid line illustrates normalized variations in uniaxial compressive strength of the rock formation. In some embodiments, the graph 510 may reflect a simulated environment or parameters measured via one or more sensors of the earth-boring tool system 102 of FIG. 1. Graph 512 shows normalized changes in WOB (the dotted line) and RPM (the dashed line) parameters responsive to changing rock properties (e.g., the variational properties shown in graph 510) performed by a human operator compared to normalized changes in WOB (the dot-dash line) and RPM (the solid line) parameters performed responsive to an operational drilling model trained via reinforcement learning using a reward function according to one or more embodiments of the present disclosure.

Graph 514 illustrates a drilling day curve (i.e., drilling performance of the earth-boring tool system 102 for a drilling operation) comparing two drilling methods, namely a drilling baseline 518 representative of a drilling operation performed by a human operator and agent-guided drilling operation 516. Specifically, the graph 514 illustrates a measurement of a percentage of time taken by the agent 516 compared to a human 518 comparing a percentage of depth achieved by the agent as a function of time measured against the human 518. Each data point of the agent 516 may represent an action taken by the agent based on input drilling parameters. Each data point of the agent in graph 514 is shaded to reflect whether the action taken by the agent at each data point was, on average, rewarded or punished as defined by a gradient reward function represented by the gradient 524. The more the agent was rewarded for a given action, the lighter the color of the data point corresponding to that action is in the graph and, conversely, the more the agent was punished for a given action, the darker the color of the data point corresponding to that action is in the graph. Each reward and/or punishment reflected in the graph 514 may, when the normalized depth of 1 is reached, be aggregated to determine a final performance metric of the agent. The policy may then be changed based on the final performance metric. For example, if the performance of the agent was overall rewarded, the policy of the agent may then be updated to map the decision made and shown in the graph 514 to actions so that, when confronting similar situations, the agent will take similar actions. Conversely, if the performance of the agent is overall punished, the policy of the agent may then be updated to map the decision made and shown in the graph 514 to actions other than those reflected in the graph 514. In some embodiments, the policy may be updated after any number of data points or for any defined depth interval.

Referring to FIGS. 1-5, the earth-boring tool system 102 of the present disclosure may use a robust reward function taking into account variables beyond those that are traditionally controlled by an operator to allow for greater control of an earth-boring tool during a drilling operation to increase the speed of the drilling operation while reducing conditions that may lead to damage to the drilling tool during the drilling operation compared to traditional methods. Accordingly, in comparison to traditional methods of controlling an earth-boring tool typically considering only RPM and WOB to increase ROP, the earth-boring tool system 102 of the present disclosure may allow for faster response to changing down-hole conditions taking into consideration more factors to reduce the risk of damage to the earth-boring tool 114.

Figure 6:
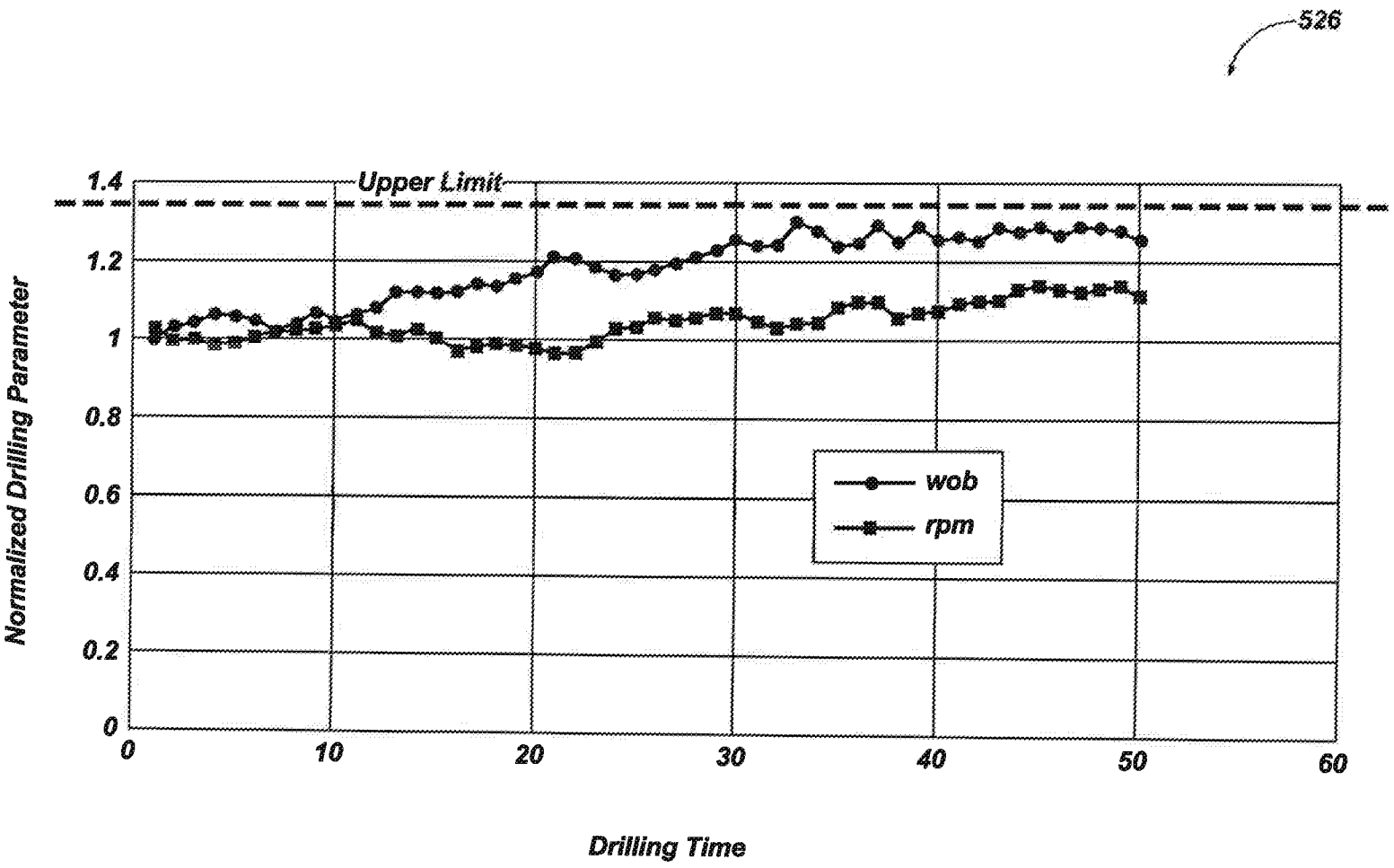
FIG. 6 shows a graph illustrating normalized weight on bit (WOB) and rotations per minute (RPM) parameters as a function of drilling time compared to a pre-determined normalized upper limit for WOB and RPM, according to one or more embodiments of the present disclosure.

FIG. 6 shows a graph 526 illustrating normalized WOB and RPM parameters as a function of drilling time compared to a pre-determined normalized upper limit for WOB and RPM, according to one or more embodiments of the present disclosure. Graph 526 illustrates the results of using a reward function that rewards increasing ROP by actions taken by an agent restricted to adjusting WOB and RPM. Adjusting WOB and RPM to increase ROP reflects the traditional approach to drilling optimization. Accordingly, in this scenario, the reward function will reward an agent's change in WOB and RPM if the ROP is increased. However, such a strategy is not realistic as focusing only on changing WOB and RPM of an earth-boring tool to increase ROP may lead to undesirable damage to the earth-boring tool, which may lead to increased costs and jeopardize the drilling operation if the earth-boring tool fails downhole.

Figure 7:
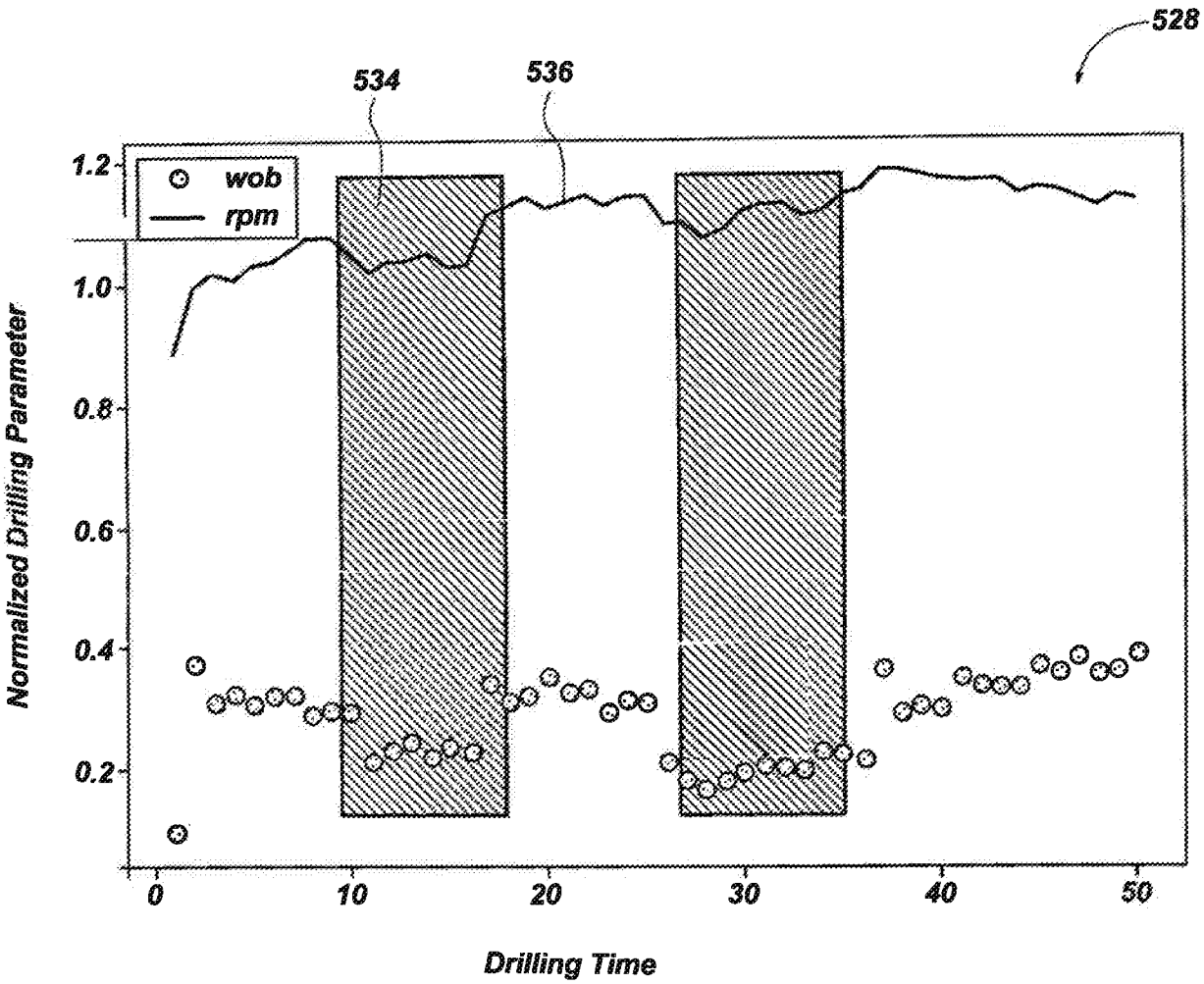
FIG. 7 shows a graph illustrating normalized WOB and RPM parameters as a function of drilling time, according to one or more embodiments of the present disclosure.

FIG. 7 shows a graph 528 illustrating normalized WOB and RPM parameters as a function of drilling time according to one or more embodiments of the present disclosure. Graph 528 shows the results of using a reward function that provides rewards or punishments beyond just increased ROP. For example, the reward function may evaluate actions of the agent based on drilling parameters such as tool vibration, tool wear, and predicted tool wear or any other parameters discussed above with regard to the earth-boring tool system 102. For example, graph 528 illustrates normalized WOB and RPM parameters as a function of drilling time according to an operational drilling model including a reward function as discussed above with regard to FIG. 3. Graph 526 also shows a duration of time during which rock formations 534 are more likely to cause damage (e.g., due to rock hardness or other rock properties) to a drilling tool (e.g., earth-boring tool 114) than other rock formations 536. Because the reward function used train the operational drilling model considers other factors than just maximizing WOB and RPM to increase ROP, the agent of the operational drilling model may lower RPM and/or WOB of a drilling tool when the drilling tool encounters rock formations more likely to cause damage to the drilling tool in order to reduce the likelihood of damage to the drilling tool, as shown in graph 528. Accordingly, the reward function disclosed herein may allow for increased ROP while adaptively adjusting parameters to avoid damage to a drilling tool.

It will be appreciated by those of ordinary skill in the art that functional elements of examples disclosed herein (e.g., functions, operations, acts, processes, and/or methods) may be implemented in any suitable hardware, software, firmware, or combinations thereof. FIG. 6 illustrates non-limiting examples of implementations of functional elements disclosed herein. In some examples, some or all portions of the functional elements disclosed herein may be performed by hardware specially configured for carrying out the functional elements.

FIG. 8 is a block diagram of circuitry 602 that, in some examples, may be used to implement various functions, operations, acts, processes, and/or methods disclosed herein. The circuitry 602 includes one or more processors 604 (sometimes referred to herein as "processors 604") operably coupled to one or more data storage devices (sometimes referred to herein as "storage 608"). The storage 608 includes machine-executable code 610 stored thereon and the processors 604 include logic circuitry 606. The machine-executable code 610 includes information describing functional elements that may be implemented by (e.g., performed by) the logic circuitry 606. The logic circuitry 606 is adapted to implement (e.g., perform) the functional elements described by the machine-executable code 610. The circuitry 602, when executing the functional elements described by the machine-executable code 610, should be considered as special purpose hardware configured for carrying out functional elements disclosed herein. In some examples, the processors 604 may perform the functional elements described by the machine-executable code 610 sequentially, concurrently (e.g., on one or more different hardware platforms), or in one or more parallel process streams.

When implemented by logic circuitry 606 of the processors 604, the machine-executable code 610 is to adapt the processors 604 to perform operations of examples disclosed herein. For example, the machine-executable code 610 may adapt the processors 604 to perform at least a portion or a totality of the flowchart 300 of FIG. 3. As another example, the machine-executable code 610 may adapt the processors 604 to perform at least a portion or a totality of the operations discussed for the system of FIG. 1. As a specific, non-limiting example, the machine-executable code 610 may adapt the processors 604 to train an operational drilling model. As another non-limiting example, the machine-executable code 610 may adapt the processors to Project latent space representations of data onto a linear trajectory regression curve.

The processors 604 may include a general purpose processor, a special purpose processor, a central processing unit (CPU), a microcontroller, a programmable logic controller (PLC), a digital signal processor (DSP), an application specific integrated circuit (ASIC), a field-programmable gate array (FPGA) or other programmable logic device, discrete gate or transistor logic, discrete hardware components, other programmable device, or any combination thereof designed to perform the functions disclosed herein. A general-purpose computer including a processor is considered a special-purpose computer while the general-purpose computer executes functional elements corresponding to the machine-executable code 610 (e.g., software code, firmware code, hardware descriptions) related to examples of the present disclosure. It is noted that a general-purpose processor (may also be referred to herein as a host processor or simply a host) may be a microprocessor, but in the alternative, the processors 604 may include any conventional processor, controller, microcontroller, or state machine. The processors 604 may also be implemented as a combination of computing devices, such as a combination of a DSP and a microprocessor, a plurality of microprocessors, one or more microprocessors in conjunction with a DSP core, or any other such configuration.

In some examples, the storage 608 includes volatile data storage (e.g., random-access memory (RAM)), non-volatile data storage (e.g., Flash memory, a hard disc drive, a solid-state drive, erasable programmable read-only memory (EPROM), etc.). In some examples, the processors 604 and the storage 608 may be implemented into a single device (e.g., a semiconductor device product, a system on chip (SOC), etc.). In some examples, the processors 604 and the storage 608 may be implemented into separate devices.

In some examples, the machine-executable code 610 may include computer-readable instructions (e.g., software code, firmware code). By way of non-limiting example, the computer-readable instructions may be stored by the storage 608, accessed directly by the processors 604, and executed by the processors 604 using at least the logic circuitry 606. Also, by way of non-limiting example, the computer-readable instructions may be stored on the storage 608, transferred to a memory device (not shown) for execution, and executed by the processors 604 using at least the logic circuitry 606. Accordingly, in some examples, the logic circuitry 606 includes electrically configurable logic circuitry 606.

In some examples, the machine-executable code 610 may describe hardware (e.g., circuitry) to be implemented in the logic circuitry 606 to perform the functional elements. This hardware may be described at any of a variety of levels of abstraction, from low-level transistor layouts to high-level description languages. At a high-level of abstraction, a hardware description language (HDL) such as an IEEE Standard hardware description language (HDL) may be used. By way of non-limiting examples, Verilog, System Verilog, or very large-scale integration (VLSI) hardware description language (VHDL™) may be used.

HDL descriptions may be converted into descriptions at any of numerous other levels of abstraction as desired. As a non-limiting example, a high-level description may be converted to a logic-level description such as a register-transfer language (RTL), a gate-level (GL) description, a layout-level description, or a mask-level description. As a non-limiting example, micro-operations to be performed by hardware logic circuits (e.g., gates, flip-flops, registers, without limitation) of the logic circuitry 606 may be described in an RTL and then converted by a synthesis tool into a GL description, and the GL description may be converted by a placement and routing tool into a layout-level description that corresponds to a physical layout of an integrated circuit of a programmable logic device, discrete gate or transistor logic, discrete hardware components, or combinations thereof. Accordingly, in some examples, the machine-executable code 610 may include an HDL, an RTL, a GL description, a mask level description, other hardware description, or any combination thereof.

In examples where the machine-executable code 610 includes a hardware description (at any level of abstraction), a system (not shown, but including the storage 608) may implement the hardware description described by the machine-executable code 610. By way of non-limiting example, the processors 604 may include a programmable logic device (e.g., an FPGA or a PLC) and the logic circuitry 606 may be electrically controlled to implement circuitry corresponding to the hardware description into the logic circuitry 606. Also, by way of non-limiting example, the logic circuitry 606 may include hard-wired logic manufactured by a manufacturing system (not shown but including the storage 608) according to the hardware description of the machine-executable code 610.

Regardless of whether the machine-executable code 610 includes computer-readable instructions or a hardware description, the logic circuitry 606 is adapted to perform the functional elements described by the machine-executable code 610 when implementing the functional elements of the machine-executable code 610. It is noted that although a hardware description may not directly describe functional elements, a hardware description indirectly describes functional elements that the hardware elements described by the hardware description are capable of performing.

As used in the present disclosure, the terms "module" or "component" may refer to specific hardware implementations to perform the actions of the module or component and/or software objects or software routines that may be stored on and/or executed by general purpose hardware (e.g., computer-readable media, processing devices, etc.) of the computing system. In some examples, the different components, modules, engines, and services described in the present disclosure may be implemented as objects or processes that execute on the computing system (e.g., as separate threads). While some of the system and methods described in the present disclosure are generally described as being implemented in software (stored on and/or executed by general purpose hardware), specific hardware implementations or a combination of software and specific hardware implementations are also possible and contemplated.

As used in the present disclosure, the term "combination" with reference to a plurality of elements may include a combination of all the elements or any of various different subcombinations of some of the elements. For example, the phrase "A, B, C, D, or combinations thereof" may refer to any one of A, B, C, or D; the combination of each of A, B, C, and D; and any subcombination of A, B, C, or D such as A, B, and C; A, B, and D; A, C, and D; B, C, and D; A and B; A and C; A and D; B and C; B and D; or C and D.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to examples containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

While the present disclosure has been described herein with respect to certain illustrated examples, those of ordinary skill in the art will recognize and appreciate that the present invention is not so limited. Rather, many additions, deletions, and modifications to the illustrated and described examples may be made without departing from the scope of the invention as hereinafter claimed along with their legal equivalents. In addition, features from one example may be combined with features of another example while still being encompassed within the scope of the invention as contemplated by the inventor.

What is claimed is:

1. An earth-boring tool system comprising:

a drill string comprising at least one drilling tool including a drill bit;

at least one processor;

at least one non-transitory computer-readable storage medium storing instructions thereon that, when executed by the at least one processor, cause the earth-boring tool system to:

receive first drilling environment data;

train an operational drilling model based, at least in part, on the first drilling environment data and a reward function, the reward function defining one or more rewards or punishments based, at least in part, on parameters including at least bit wear, rate of penetration (ROP), vibration, and cutter durability;

receive second drilling environment data; and determine, via the operational drilling model, one or more first actions based on the second drilling information data, the one or more first actions configured to change one or more operating parameters of the earth-boring tool system engaged in a drilling operation, the changed one or more parameters used to increase the ROP and prevent wear or damage to the at least one drilling tool in the drilling operation.

2. The earth-boring tool system of claim 1, the at least one non-transitory computer-readable storage medium storing instructions thereon that, when executed by the at least one processor, cause the earth-boring tool system to:

perform, via an agent of the operational drilling model, one or more second actions based, at least in part, on the first drilling environment data and a policy corresponding to the agent;

generate one or more predicted drilling parameters based on the one or more second actions performed by the agent;

provide the one or more predicted drilling parameters to the reward function to generate one or more rewards or punishments based, at least in part, on the predicted drilling parameters; and update the policy corresponding to the agent based, at least in part, on the one or more rewards or punishments.

3. The earth-boring tool system of claim 2, wherein the instructions stored on the at least one non-transitory computer-readable storage medium, when executed by the at least one processor, cause the earth-boring tool system to:

update the policy corresponding to the agent responsive to a determination that a predetermined drilling depth has been reached, the policy updated based, at least in part, on one or more rewards or punishments provided via the reward function during the drilling operation.

4. The earth-boring tool system of claim 1, wherein the operational drilling model is configured to generate a predicted state of the earth-boring tool system based on the first drilling environment data.

5. The earth-boring tool system of claim 4, wherein the reward function comprises a pre-trained neural network configured to predict a reward or a punishment based on the drilling parameters.

6. The earth-boring tool system of claim 4, wherein the reward function comprises one or more physics-based models configured to predict a reward or a punishment based on the drilling parameters.

7. The earth-boring tool system of claim 4, wherein the reward function comprises a map or look-up table generated from offset well data, configured to predict a reward or a punishment based on the drilling parameters.

8. The earth-boring tool system of claim 1, wherein the reward function defines the one or more rewards or punishments based on one or more of the drilling parameters compared to a reference baseline drilling policy.

9. The earth-boring tool system of claim 1, wherein the reward function defines the one or more rewards or punishments based on the drilling parameters further including bit durability, and the vibration comprises one or more of Stick Slip, whirl, and High Frequency Torsional Oscillation (HFTO).

10. The earth-boring tool system of claim 1, wherein the first or second drilling environment data is based, at least in part, on a physics-based model or a data-driven model trained on lab or field data.

11. The earth-boring tool system of claim 1, wherein the first or second drilling environment data is based, at least in part, on a search map or look-up table that is generated using lab or offset-well data.

12. The earth-boring tool system of claim 1, the at least one non-transitory computer-readable storage medium storing instructions thereon that, when executed by the at least one processor, cause the earth-boring tool system to:

update one or more operational parameters of the earth-boring tool system responsive to one or more states of the earth-boring tool system determined by the operational drilling model.

13. The earth-boring tool system of claim 12, wherein the one or more operational parameters include one or more of ROP, weight on bit (WOB) and rotations per minute (RPM).

14. The earth-boring tool system of claim 12, wherein the second drilling environment data comprises real-time drilling environment data.

15. A method of training a machine-learning model via reinforcement learning, the method comprising:

receiving first drilling environment data;

determining, via an agent, one or more first actions configured to change one or more operational parameters of an earth-boring tool system based, at least in part, on the first drilling environment data and a drilling policy corresponding to the agent, the earth-boring tool system comprising at least one drilling tool including a drill bit;

simulating, via a predictive machine learning model, one or more future states of the earth-boring tool system based on the first drilling environment data and the one or more first actions to generate predicted drilling parameters;

providing, via a pre-defined reward function, one or more rewards and/or one or more punishments to the agent based, at least in part, on the pre-defined reward function and the predicted drilling parameters, the pre-defined reward function being a function of drilling parameters including at least bit wear, rate of penetration (ROP), vibration, and cutter durability;

updating the drilling policy based on the one or more rewards or the one or more punishments;

receiving second drilling environment data; and determining, via the agent, one or more operational parameters of the earth-boring tool system based on the second drilling environment data, the determined one or more operational parameters used in a drilling operation to increase the ROP and prevent wear or damage to the at least one drilling tool.

16. The method of claim 15, further comprising:

operating the earth-boring tool system in the drilling operation using the at least one drilling tool.

17. The method of claim 15, wherein the vibration comprises one or more of Stick Slip, whirl, and High Frequency Torsional Oscillation (HFTO).

18. The method of claim 15, wherein the pre-defined reward function determines the one or more rewards and/or the one or more punishments based on a comparison between one or more of the predicted drilling parameters and one or more pre-defined baseline drilling parameters.

19. The method of claim 15, wherein the predictive machine learning model comprises a physics-based model configured to simulate a drilling operation.

20. A non-transitory computer-readable medium storing instructions thereon that, when executed by at least one processor, cause the at least one processor to perform steps comprising:

receive first drilling environment data;

determine, via an agent, one or more first actions configured to change one or more operational parameters of an earth-boring tool system based, at least in part, on the first drilling environment data and a drilling policy corresponding to the agent, the earth-boring tool system comprising at least one drilling tool including a drill bit;

simulate, via a physics-based predictive machine learning model, one or more future states of the earth-boring tool system based on the first drilling environment data and the one or more first actions to generate predicted drilling parameters;

provide, via a pre-defined reward function, one or more rewards and/or one or more punishments to the agent based, at least in part, on the pre-defined reward function and the predicted drilling parameters, the pre-defined reward function being a function of drilling parameters including at least bit wear, rate of penetration (ROP), vibration, and cutter durability;

update the drilling policy based on the one or more rewards or the one or more punishments;

receive real-time drilling data via one or more sensors of the earth-boring tool system;

determine, via the agent, drilling parameters of the earth-boring tool system based on the real-time drilling data and the policy corresponding to the agent; and change one or more operating parameters of the earth-boring tool system based, at least in part, on the drilling parameters determined by the agent, the changed one or more parameters used in a drilling operation to increase the ROP and prevent wear or damage to the at least one drilling tool.

* * * * *